US006050920A

United States Patent [19]

Ehrenfried

[11] Patent Number: 6,050,920

[45] Date of Patent: Apr. 18, 2000

[54] ELECTROMECHANICAL RESISTANCE EXERCISE APPARATUS

[75] Inventor: Ted R. Ehrenfried, Portsmouth, Va.

[73] Assignee: Ehrenfried Technologies, Inc., Suffolk, Va.

[21] Appl. No.: 08/909,905

[22] Filed: Aug. 12, 1997

Related U.S. Application Data

[63] Continuation of application No. 08/416,583, Mar. 31, 1995, Pat. No. 5,697,869, which is a continuation of application No. 08/070,750, Jun. 2, 1993, abandoned.

[51] Int. Cl.[7] ..... A63B 21/005

[52] U.S. Cl. ..... 482/6; 482/5; 482/7; 482/129

[58] Field of Search ..... 482/54, 72, 1, 482/4–7, 51, 52, 92, 94, 98, 100, 121, 127, 129, 130, 133, 900, 901

[56] References Cited

U.S. PATENT DOCUMENTS

| | | | |
|---|---|---|---|
| 4,765,613 | 8/1988 | Voris | 482/4 |
| 4,842,274 | 6/1989 | Oosthuizen et al. | 482/4 |
| 4,979,733 | 12/1990 | Prud'Hon | 482/4 |

*Primary Examiner*—John Mulcahy
*Attorney, Agent, or Firm*—Kenyon & Kenyon

[57] ABSTRACT

A strength and exercise apparatus that provides an opposing resistive force which in its total will always only equal the potential and varying exerted force created by the user. The apparatus will also have the ability to create an exerted force which in its total will always only equal the potential and varying resistive force provided by the user.

1 Claim, 8 Drawing Sheets

ELECTROMECHANICAL RESISTANCE EXERCISE APPARATUS

This application is a continuation of application Ser. No. 08/416,583, filed on Mar. 31, 1995, now U.S. Pat. No. 5,697,869, which is a continuation of application Ser. No. 08/070,750, filed Jun. 2, 1993, now abandoned.

BACKGROUND OF THE INVENTION

The present invention relates generally to muscle exercise apparatus and more specifically to exercise apparatus capable of providing both positive and negative exercise over a range of motion.

A muscle produces force when it contracts. One form of exercise is called isometric exercise; the muscle length remains constant as the muscle contracts against force applied by an opposing muscle or against an immovable object.

Other forms of exercise involve shortening or lengthening a muscle through a range of movement of a limb about a joint. Movement in the direction of the muscle contracting force against an external resistance shortens the muscle and is called concentric contraction. Movement caused by a greater external force in a direction opposite to the muscle contracting force lengthens the muscle and is called eccentric contraction. Concentric contraction is known as positive exercise; eccentric contraction is called negative exercise.

Since isometric exercise pits a muscle against another muscle or against an immovable object, no special equipment is needed. Most exercise equipment, therefore, is not of this type, although many dynamic machines may also be used in the static mode to provide isometric exercise.

The most common type of exercise apparatus uses weights or their equivalent to provide isotonic exercise, in which a constant external resistance force is applied during a dynamic contraction, so that the speed of movement varies in response to the varying muscle force output at each point of a range of motion.

The geometric relationship between muscle anchoring points and joint locations, however, normally results in a maximum output force at some intermediate point in the range of motion of a given limb as it is moved by muscles about its joint. Thus, when using a pure isotonic exercise apparatus, such as a barbell or a stack of rail-guided weights lifted by a cable, the weight selected for exercising a given muscle or muscle group over a range of motion of the corresponding limb is limited by the force that can be exerted at the weakest point in the range of motion. Consequently the muscle or muscle group exerts less than its maximum potential force at all points of the range of motion except the weakest point.

Simple weight lifting devices also have the potential to cause muscle injury when the full mass of the weight is being accelerated at the start of the lift. If the weight is supported by a spring, then the resistive force of the mass/spring systems increases gradually until the compressed spring reaches its neutral position. U.S. Pat. No. 5,117,170 of Keane et al. discloses a control circuit for an electric motor to produce a counterforce upon rotation of the motor shaft from a zero position that simulates a weight stack supported by a spring.

Another type of exercise device uses springs instead of weights to provide a resisting force. A spring that has been displaced from its neutral position exerts a restoring force that directionally opposes and linearly varies with the displacement. Exercise machines based on springs for the provision of force are thus capable of providing both positive (concentric contraction) and negative (eccentric contraction) exercise over a range of motion. However, the monotonically rising straight line force curve of a conventional linear spring also does not match the force/displacement curve of a muscle-actuated limb/joint combination. This has tended to limit the utility of spring-based exercise apparatus.

A further type of exercise device known as an isokinetic machine was developed. In isokinetic exercise, the speed of the exercise motion is held constant during contraction. Such devices generally do not provide negative resistance, even though negative resistance is very desirable in many exercise regimes.

Examples of exercise machines are set forth in U.S. Pat. Nos. 3,465,592 to Perrine, 5,011,142 to Eckler, 4,261,562 to Flavell, and 5,180,351 to Ehrenfried, the contents of which are incorporated herein by reference.

Some experts believe that a muscle must be pushed to its maximum strength limit to derive maximum muscle hypertrophy. This approach calls for repetitive cycles of concentric contraction and eccentric contraction against a level of resistance until reaching a point of momentary muscle failure. The user then reduces the level of resistance and resumes the workout until a second momentary muscle failure is reached. The steps of resistance reduction leading to momentary muscle failure are repeated until the muscle reaches its absolute fatigue point, at which the muscle is incapable of working against resistances as low as 10% of the initial resistance of the workout.

The variables to consider in designing a workout program also include the time interval for each portion of an exercise cycle. Some experts believe that two seconds of positive (concentric) contraction followed by four seconds of negative (eccentric) contraction is optimal. Others maintain that a briefer, higher power concentric contraction of very short duration, followed by isometrically restraining an imposed load until muscle failure forces the lowering of the load, is the most effective.

There remains a need, therefore, for a versatile exercise machine that incorporates many of the advantages present in various prior art machines without their disadvantages. Ideally, such a machine should permit the user a broad range of exercise regimes.

SUMMARY OF THE INVENTION

It is therefore an object of the invention to provide a resistance system that does not constrain the user to respond to load patterns set by the machine independently of the actual strength or applied effort of the user, but rather creates loading demands on the user in response to his varying strength and applied effort (see the graph in FIG. 4).

It is an additional objective to provide a machine that provides advantages of a number of prior art systems without their deficiencies.

It is an additional objective to develop a diverse system that will provide many user options through the control of the speed of a single uni-directional motor.

It is a further objective to provide a machine that collects data regarding the user's workout and then displays the data in an appropriate form for user feedback.

It is an objective to provide a machine that can monitor the user's performance and downwardly adjust the loads imposed on the user when necessary, or increase the loads when desirable.

Yet another object is to provide an adjustable force threshold to capture a force level achieved in one range of motion cycle for use as the threshold resistance to be overcome at the start of the succeeding repetition. This threshold resistive force for each repetition would thus be directly related to the user's increasing or decreasing strength as determined from the preceding repetition. Force generating features of this invention provide an opposing force that rises with user velocity during a concentric contraction (see the graph in FIG. 5) and falls during an accelerating eccentric contraction (see the graph in FIG. 6).

DESCRIPTION OF THE PREFERRED EMBODIMENTS

The preferred embodiment of the apparatus of the invention may be considered as comprising three subsystems that will be discussed in turn. They are: first, a positive workout force generating subsystem; second, a safety latching and threshold load generating subsystem; and third, a negative workout force generating subsystem.

The first subsystem forms the basic invention and could be used alone as a simple and inexpensive exercise apparatus. The second subsystem prevents possibly injurious rapid recoil of the force spring of the first subsystem and also enables the user to increment the load present at the start of a given repetition as a fraction of the peak load in the previous repetition. The third subsystem generates forces to provide a negative workout.

A microprocessor, data collection sensors, electronic displays, and electronic control of the apparatus constitute a fourth subsystem, which will be discussed in the final section.

1. Positive Workout Force Generating Subsystem.

Figure 1:
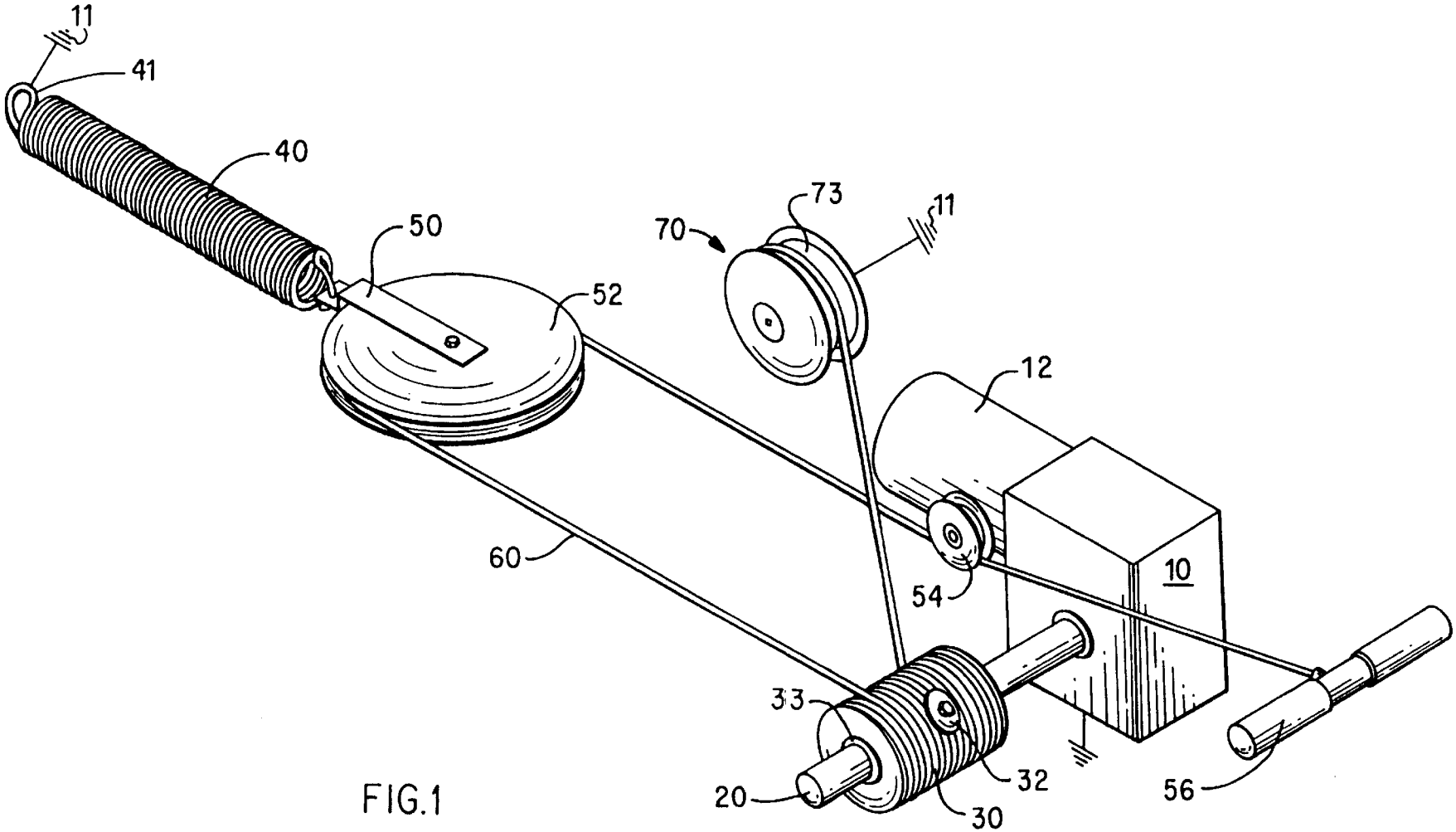
FIG. 1 is a schematic perspective view of a positive workout force generating system according to the invention.
Figure 2:
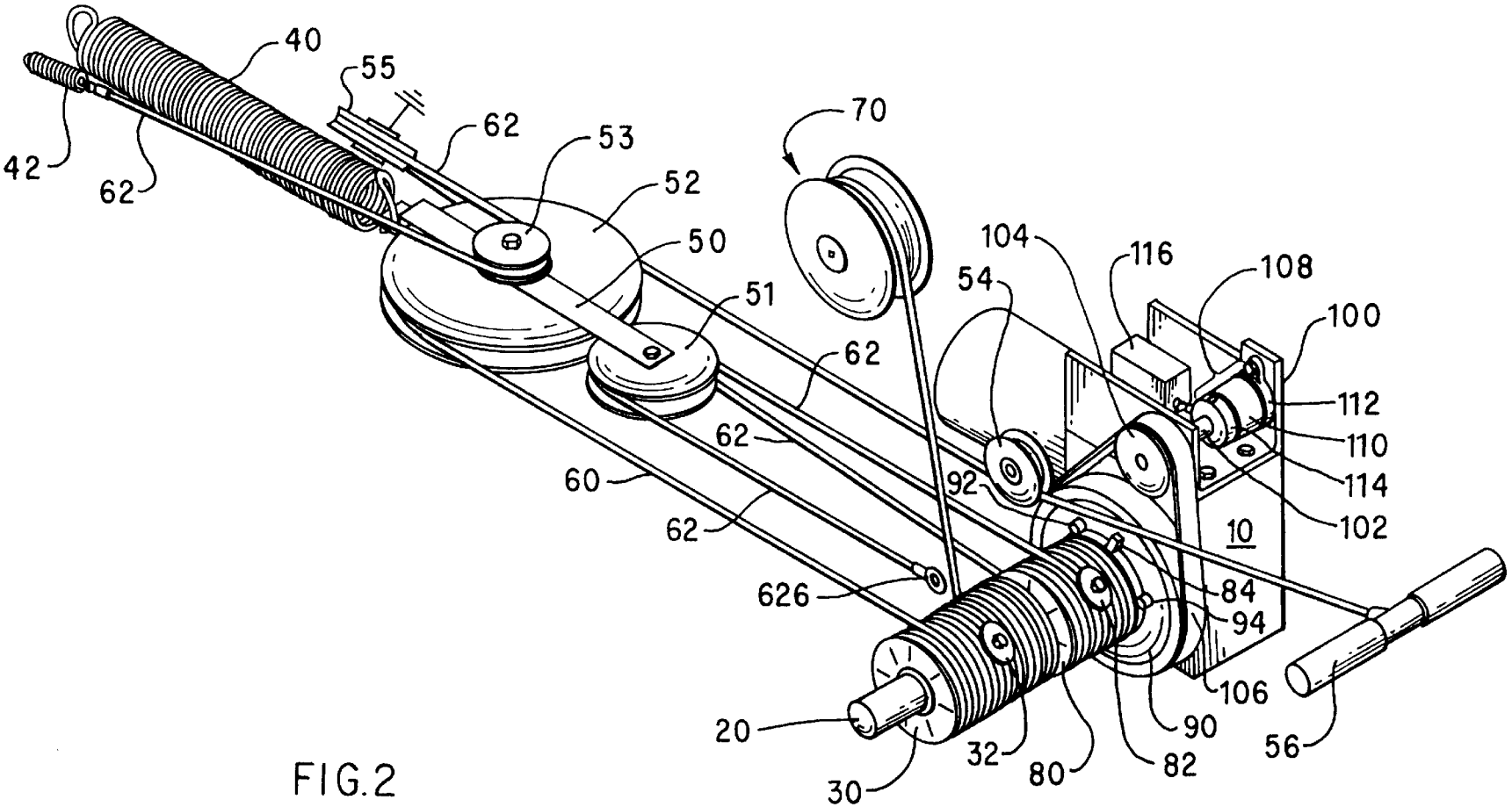
FIG. 2 is a schematic perspective view of the system shown in FIG. 1, with the addition of certain force capture and control elements.
Figure 3:
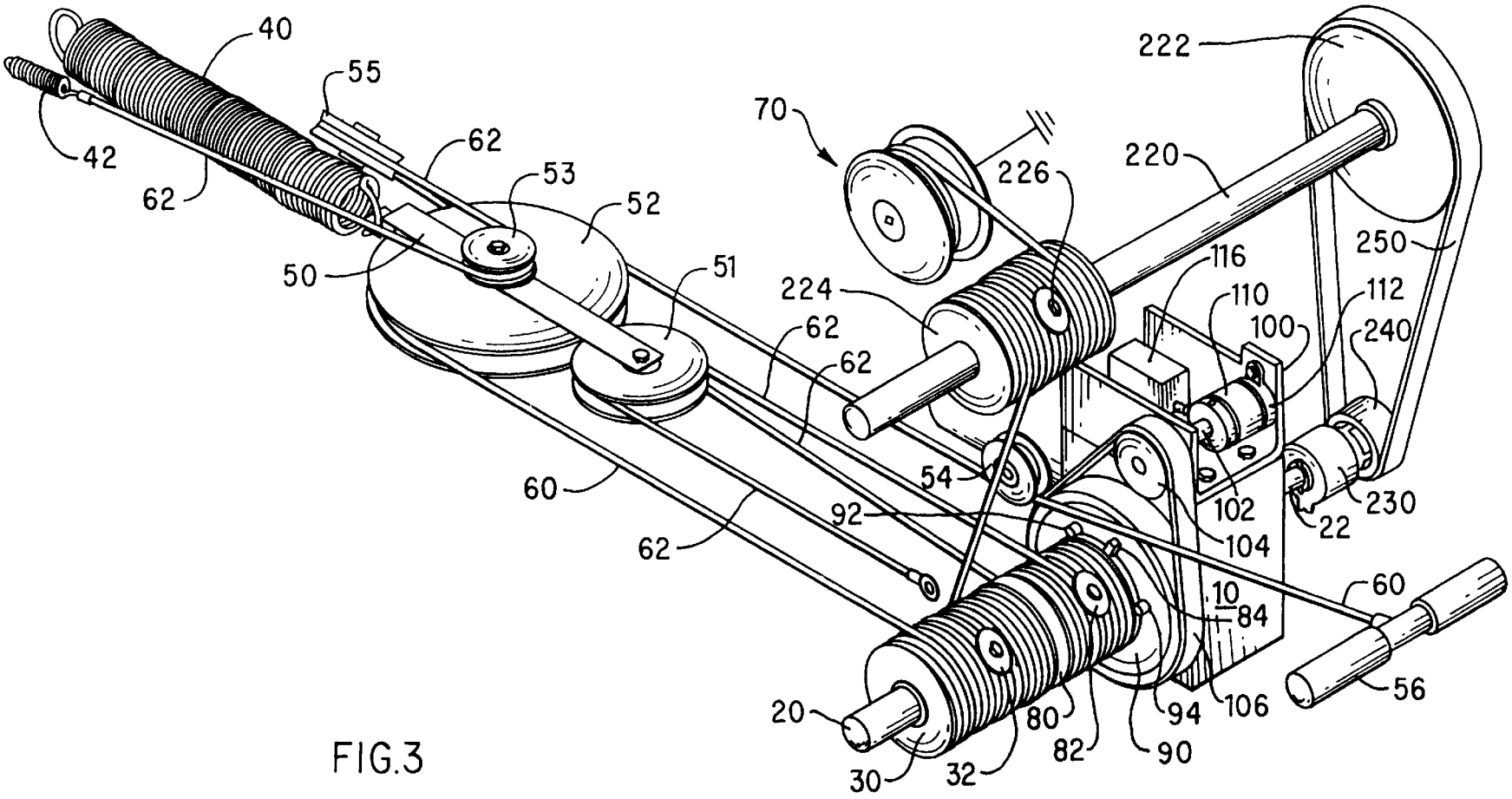
FIG. 3 is a schematic perspective view of the system shown in FIG. 2, further including elements to provide a negative workout force generating system.
Figure 4:
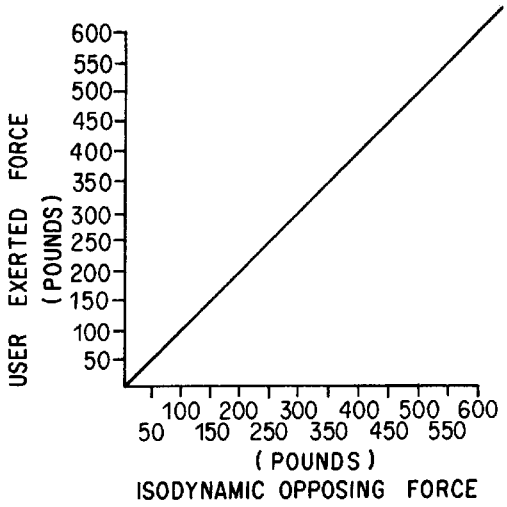
FIGS. 4–18 are force versus range of motion diagrams illustrating exercise modes of the invention.
Figure 5:
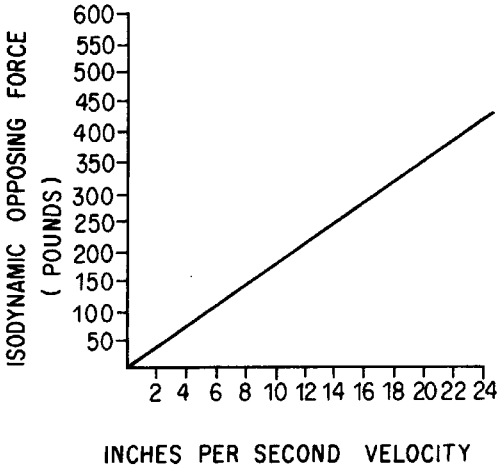
Figure 6:
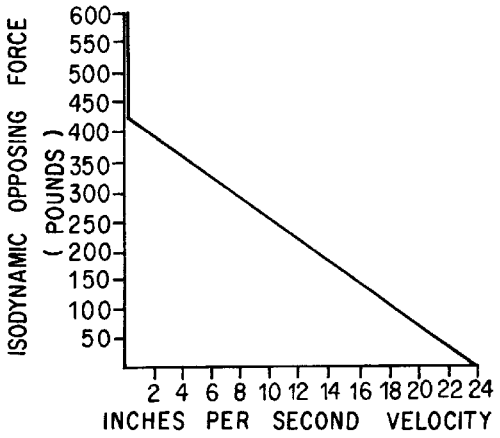

With reference to FIGS. 1–3, the same reference numerals designate the same parts throughout. FIG. 1 shows in schematic perspective form the basic positive workout force generating subsystem of the invention. In FIG. 1, a constant speed drive comprising a single-reduction wormgear 10 is mounted on an apparatus frame 11. An electric motor 12 drives the wormgear 10 in a direction that causes an output shaft 20 to turn counterclockwise at a user selected speed. A DC motor speed controller (not shown) provides consistent motor speed to ensure that the worm output shaft 20 maintains the selected speed under the various loads imposed during operation.

It is within the scope of this invention to use any other constant speed drive device (e.g., a flywheel and brake a generator or alternator, or a centrifugal brake) instead of an electric motor and wormdrive to provide the same general operational characteristics.

Located on the output shaft 20 is a spirally-grooved speed control drum 30 equipped with a midpoint cable anchoring bolt 32 threaded into the drum. A one-way clutch 33 disposed within the speed control drum 30 permits the output shaft 20 to turn counter-clockwise within the drum 30 without providing any driving connection to the drum. The clutch also allows the drum to rotate clockwise without restriction from the counterclockwise rotating output shaft, but does not allow the drum to rotate in a counterclockwise direction with respect to the shaft (i.e., at a speed greater than the counterclockwise rotation of the output shaft).

A force spring 40 has one end 41 attached to the apparatus frame 11 and an opposite end attached to a floating pulley bracket 50, which carries a force spring pulley 52. The force spring 40 serves as the force generating element within the system and, although shown as a single tension coil spring, could be provided as a compression spring or as a compound spring.

A user cable 60 has one end connected to a rewind device 70, such as a spiral spring connecting an arbor that is fixed to the apparatus frame 11 and a drum portion 73. The cable is wound on the drum such that withdrawal of cable rotates the drum clockwise while increasing the tension exerted by the spiral spring on the user cable 60. Spring-actuated counterclockwise rotation of the drum 73 rewinds cable onto the drum and occurs whenever the tension exerted by the spiral spring exceeds the force pulling on the cable.

After anchoring the cable 60 to the drum 73, the spiral spring is pre-tensioned to a 15 pound load with at least three wraps or turns of cable pre-wound onto the drum 73. The cable is then advanced to the speed control drum 30 and is wrapped about the middle half of the speed control drum 30, leaving the inner and outer one-quarter of the grooves on the drum 30 free to accept additional length of cable. The cable is anchored to the speed control drum 30 via the threaded anchor bolt 32 at the midpoint of the drum.

The user cable 60 is then reeved through the force spring pulley 52, passed through a re-directional pulley 54, and finally advanced to a user engagement device. In the illustrated embodiment, the user engagement device is a handle 56; however, it may be any of a number of other devices known in the field of exercise apparatus, such as a lever or crank.

The operation of the apparatus shall be explained by an example of a 36-inch range of movement for a concentric contraction, such as might be produced by a rowing stroke applied to the handle 56. This entails the extraction of 36 inches of cable 60 from the apparatus.

Prior to performing an exercise, the user first selects the approximate speed desired for each repetition. If, for example, the user chooses to work out with a three second concentric contraction period, then the full 36 inch length of cable must be extracted within three seconds.

There are two sources of cable 60 available to accommodate the user's exercise stroke. The first source is the length of cable 60 located between the user and the speed control drum 30. If the speed control drum 30 were held stationary as the user pulled on the cable, the force spring 40 would be extended until its tension force reached twice the pulling force exerted by the user on the handle 56, since the portion of cable 60 reeved through pulley 52 forms a two-part line with equal tension on both parts.

Let us further assume that in this example the balancing of these two opposing forces occurs at a spring extension of six inches. This will result in twelve inches of cable being withdrawn from the two-part line to provide one-third of the thirty-six inch range of motion requirement (of course, the use of more elaborate compound pulley arrangements would alter these proportions).

The second source of cable 60 is that length of cable wound onto on the outer half of the mid section of the speed control drum 30. To simplify the discussion, it is assumed that the speed control drum has a circumference of twelve inches; therefore two full turns (which correspond to 24 inches) of cable must be made available from the speed control drum to complete the thirty-six inch range of motion requirement (in addition to the twelve inch length of cable made available by the six inch elongation of the spring). Moreover, this length of cable must be made available over a period of time not exceeding the three second concentric interval desired.

Simplifying the user's range of motion excursion as involving two steps: first, providing cable only through the extension of the spring, and second, paying out cable only from the speed control drum 30, the following sequential development of force results. Assume that the force spring has a spring constant of K=20 lbs/inch; then each inch of spring extension will increase the tension of force spring 40 by twenty pounds. At the conclusion of the first one-third of the range of motion, a total of one hundred and twenty pounds of tensioning force would be developed in the force spring (6 inches times 20 lbs/inch). The user would experience sixty pounds of resistance through the two part line reeving, and twelve inches of cable would be made available to accommodate the range of motion excursion. In the second step, the completion of the final two-thirds of the range of motion excursion requires that cable located on the speed control drum 30 be paid out and so made available. Such a payout of cable 60 from the outer position of the drum 30 entails the counterclockwise rotation of the drum 30. Since the drum 30 is coupled to the output shaft 20 by a one-way clutch in such a way that the drum cannot rotate counterclockwise with respect to the shaft, the drum cannot rotate faster than the user selected speed of shaft 20.

If we were to proportionally allocate the three second interval time objective to the inches of cable demanded in each step, the second step would have to be completed in two seconds (as we have assumed that the provision of the initial 12 inches of cable in the first step took 1 second). This means that the motor must drive the wormgear at a speed that will result in a counterclockwise worm output. shaft speed of sixty revolutions per minute. Since the speed control drum 30 can turn no faster than the output shaft 20, the amount of cable made available during the two seconds it takes for the drum 30 to make two revolutions is 24 inches.

Figure 7:
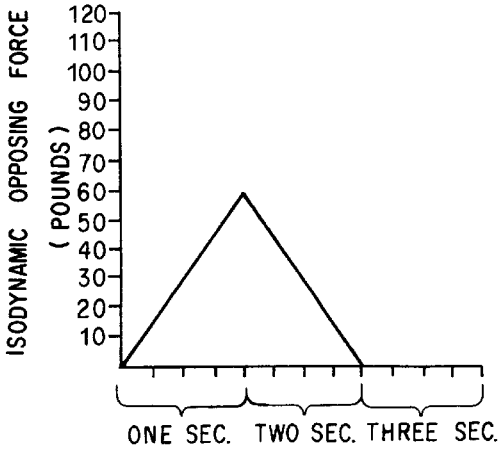
Figure 8:
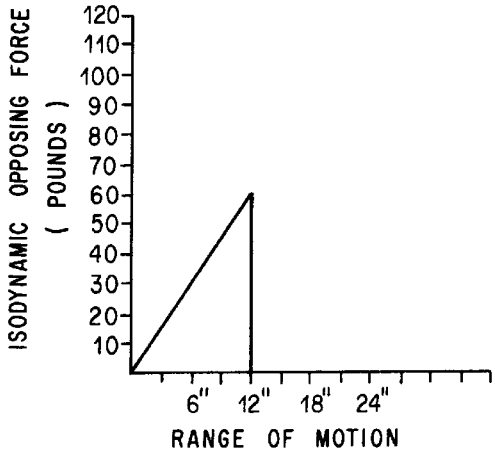

As soon as the output shaft begins turning at a speed of sixty revolutions per minute, one or a combination of the following scenarios must occur. If the user makes no effort to complete the last two-thirds (24 inches) of the range of motion excursion, then the force developed in the force spring 40 will be transmitted through the force spring pulley 52 and user cable 60 to speed control drum 30, which would be driven by the cable to make one revolution. This will make available twelve inches of cable from the drum 30, which acting through the force spring pulley 52, would allow the force spring 40 to recoil six inches with the resulting dissipation of the force developed within the force spring to zero over a period of one second (see the graph in FIG. 7). The user would cease to experience any resistive effort, and no additional cable would be taken from the speed control drum until the user elects to complete the range of motion objective (see the graph in FIG. 8).

Figure 9:
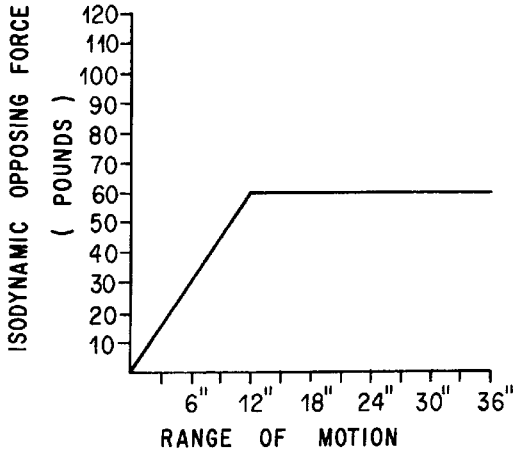

If when the output shaft 20 commenced its rotation, the user instead elected to complete the range of motion objective, then a different situation would develop. As long as the user's range of motion effort consumes in total an amount of cable equal to the total cable being released from the speed control drum, then the force spring 40 will not be able to recoil. This means that the user would experience the force spring's sixty pounds of applied load through the final two-thirds of the range of motion during which the user's concentric contraction effort would equal the tensile load applied by the extended spring through the pulley reeving (see the graph in FIG. 9). Thus, during this period, the user would experience an isotonic-like workout such as he would have experienced in lifting a sixty pound stack of weights against gravity.

Figure 10:
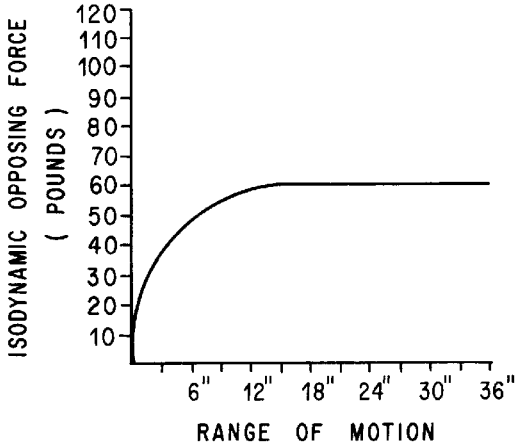

The discussion thus far presents a simplified view of the interaction between user and apparatus, as in reality a combination of both user and apparatus effects mediate the load pattern experienced during a given repetition. In practice, the wormgear output shaft would typically be turning at a constant speed of rotation from the start of the three second repetition. At the beginning of the repetition, many users would tend to exert a maximal pulling effort on the cable 60. The velocity of the cable at the user end 56 would initially exceed the speed of the cable being made available from the speed control drum 30. As this inequality of speed continues, the force spring pulley 52 will be moved forward towards the re-directional pulley 54 to make available additional length of cable required by the user. As the force spring pulley 52 continues to move toward the re-directional pulley 54, the increased tensioning provided by the force spring 40 increases until a force developed by the spring 40 effectively matches the user's effort. Eventually, increases in the force developed within the force spring cause the user to reduce the rate at which he extracts the cable to a point where the spring 40 ceases to lengthen; at this point the speed of the user cable 60 at the handle 56 will equal the speed of the cable being released by the speed control drum (see the graph in FIG. 10).

Figure 11:
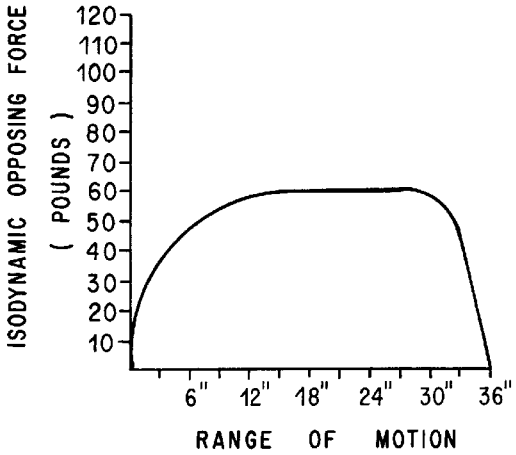

As the user reaches the end of the range of motion excursion, both fatigue and the increasingly unfavorable leverage that typically arise at the end of an exercise stroke will generally cause the user's positive effort to decrease below the effective load of the force spring 40. This causes the velocity of the cable 60 at the user point of engagement 56 to decrease and so require less cable per unit of time than is payed off by the speed control drum. This allows the force spring 40 to recoil by an amount that will result in its supplied force decreasing to a level equaling the user's decreased concentric contraction effort. As the user decreases his concentric contraction effort, either within a repetition because of variations of his strength curve, or from repetition to repetition because of fatigue, there is a concomitant drop in the velocity or cable end, which is continually and automatically matched by further force reductions in the force spring 40. During this bilateral decreasing force equalization stage, the range of motion velocity is proportionally reduced until both the apparatus developed resistive force and the velocity with which user encounters it fall to zero (see the graph in FIG. 11).

As the user returns the handle 56 to its initial position for the next repetition, the spring tension of the rewind device 70 causes the drum reel to retract the cable 60 that had been transferred from it to the speed control drum during the previous repetition. The resulting clockwise rotation of the speed control drum 30 will simultaneously cause the now slackening cable 60, to be rewound on the outside section's inner one-half of the speed control drum.

The aforementioned apparatus has accomplished most goals set forth above. It allows for the beginning portion of the range of motion excursion to experience a minimal resistive force. It allows for the resistive force to be increased to a level of intensity equalizing, but not exceeding, the user's strength curve. It is responsive to the user's decreased range of motion velocity as the user nears the conclusion of an exercise stroke by proportionally decreasing the force spring's resistive force in proportion to the decreases in the user's concentric contraction effort. The employment of a live dead end (i.e., at the junction of the cable 60 and bolt 32) via utilization of the speed control drum causes the resulting resistive effort developed to replicate the effects of gravitational pull.

2. Force Control System

One of the possible drawbacks to the embodiment thus far described arises from the speed with which a spring under tension tends to recoil once its external balancing force is removed. If left unchecked, the velocity with which the force spring 40 might dissipate its tension could potentially damage the spring 40, the apparatus, and possibly the user. The embodiment illustrated in FIG. 2 includes additional structure which prevents such rapid spring recoil from occurring.

The structure that provides this feature is also utilized to provide another very useful feature—the "capture" of a portion of the maximum spring load attained on a given repetition as a pretension or preloading of the spring. This creates an initial load that must be overcome at the start of a subsequent repetition. FIG. 2 illustrates the apparatus of FIG. 1, with the addition of components that allow for the containment and selective capture of the maximum force developed within the force spring 40. As shall be explained below, the pretensioning of the spring load as a function of the force developed in the previous repetition is optional at the user's election.

In FIG. 2, a force control drum 80 is provided as a second grooved cable drum on the output shaft 20, and is similar in structure to the speed control drum 30. Force control drum 80 is provided with a midpoint cable anchoring bolt 82 threaded into the outer surface of the drum 80, similar to the cable anchoring bolt 32 provided on the speed control drum 30. The drum 80 (similar to speed control drum 30) is provided with a one-way clutch having a directional orientation that allows the output shaft 20 to turn counterclockwise with respect to the drum 80. The clutch does not allow the force control drum 80 to rotate in a counterclockwise direction at a speed greater than the counter-clockwise rotation of the output shaft 20. The drum 80 is provided with an integral tab 84 that protrudes outwardly from the edge of the drum furthest from the speed control drum 30.

A timing belt pulley 90 is positioned on the wormgear output shaft 20 between the inner surface of the force control drum 80 and the body of the wormgear 10. It is equipped with roller bearings pressed into its hub that enable it to freely rotate in either direction. Two protruding posts, 92 and 94, are located along an arc of typically (though not necessarily) less than 180° on the side of the force transfer pulley 90 facing the force control drum 80. During assembly, the tab 84 on the force control drum is positioned between post 92 and post 94.

A "U" shaped bracket 100 is attached to the top of the wormgear body 10. This bracket supports additional components that comprise the braking control elements of a tension release system for the force spring 40. A brake control shaft 102 is mounted on bearings within the bracket. A timing belt pulley 104 is permanently affixed to the shaft for rotation therewith at a point outside the bracket on the side facing the drums. The function of this pulley is to act as a braking control pulley (as it shall hereinafter be termed). The other end of the brake control shaft 102 is provided with a snap-ring (not shown) in place outside the bracket for locking the brake control shaft against axial movement. A timing belt 106 provides a power train connection between the brake control pulley 104 and the force control drum 80. The timing belt 106 may take the form of a chain or a toothed belt, and the rim of the force transfer pulley 90 and the braking control pulley 104 may include cylindrical teeth or a sprocket so as to provide a slip-free connection with the timing belt 106.

A one-way brake 108 with release collar 110 is mounted on the brake control shaft within the walls of the bracket. The inner hub 112 of the brake is fixedly attached to the inner surface of the outer wall of the bracket. The outer hub 114 of the brake is pinned to the brake control shaft. The brake is oriented with respect to the shaft so as to permit the brake control shaft and pulley 104 to rotate unopposed in the clockwise direction, while prohibiting their rotation in the counterclockwise direction, unless the brake release collar 110 has been rotated. The brake release collar 110 is located between these two hubs. A pull-type force control solenoid 116 is mounted on the bracket to the rear and in a centered relationship to the brake release collar. A mechanical linkage attaches the solenoid's pull-type action to the brake release collar 110, which is normally kept in a spring loaded locked position.

As shown in FIG. 2, the floating pulley bracket 50 has two additional pulleys attached to it. The upper pulley, the force retaining pulley 51, is in line with the force spring pulley 52 and has a diameter that is smaller than that of the force spring pulley 52. A second pulley, known as the activating control pulley 53, is mounted coaxially with the force spring pulley 52. An additional pulley 55 is attached to the frame and serves as a re-directional control pulley.

A force control cable 62 is dead ended onto the frame at 62G and then routed around the force retention pulley 51 back towards the force control drum 80. The force control cable 62 is wrapped about the center half of the drum 80 in the direction of the force transfer pulley so that the outer quarter sections of the drum are free to accommodate additional lengths of cable. The cable is then anchored to the drum 80 via the threaded midpoint cable anchoring bolt 82. The cable is then routed under the re-directional control pulley 55, around the activating control pulley 53 and back to a spring-loaded dead end 42 connected to the frame. The spring-loaded dead end 42 serves to take up any slack at that end of the force control cable 62.

In operation, either the microprocessor or the user has the ability to control activation of the force control solenoid and resulting disengagement of the force control brake. The operation of this system will again be set forth in terms of a positive (concentric) rowing motion as described above. As the user begins his workout by moving the handle 56 and the attached end of the user cable 60, he will tend to pull on the cable faster than it can be unwound from the speed control drum 30, causing the force spring 40 and the floating pulley bracket 50 to move forward towards the user as explained earlier. This movement simultaneously moves the activating control pulley 53 forward, which in turn causes cable 62 to be unwrapped from the inner half of one-half of the force control drum 80 abetting the force transfer pulley 90. As this occurs, a corresponding length of force control cable 62 is wrapped onto the other end of drum 80. This length of cable is made available from the slack cable created by the simultaneous forward movement of the force retention pulley 51.

The winding and unwinding of cable onto drum 80 cause the force control drum 80 to rotate in a clockwise direction. As this rotation continues, the force control drum tab 84 will eventually make contact with the forward post 94 on the force transfer pulley 90. When this contact is made, the continuing rotation of the force control drum causes the force transfer pulley 90 to commence clockwise rotation with the resulting clockwise rotation of the brake control pulley 104 and brake control shaft 102.

Following the numerical constraints posited with regard to the description of the force generating system, user executing a 36 inch rowing stroke causes the force generating spring 40 and the force control pulley 52 to move six inches. This amount of travel is accompanied by one full revolution of the twelve inch circumference force control drum 30 to pay off the additional 24 inches of cable necessary to complete the 36 inch stroke. As the user reaches the conclusion of the stroke, the velocity of the user cable 60 at handle 56 will tend to fall in the face of the increasing force supplied by the force spring 40. As noted, tensioned springs tend to recoil rapidly. However, the force control drum and associated structure prevent this outcome.

As the force spring 40 begins to recoil, the force control drum releases cable to the force retention pulley 51 at a speed that is limited by the set counterclockwise speed of rotation of the wormgear output shaft 20. Moreover, the force control drum can rotate in a counterclockwise direction only until its integral tab 84 has revolved from its point of contact on the forward most post 94 on the force transfer pulley to the rear post 92. The rear post contact will be met with the braking energy of the force control brake, which will prevent any further counterclockwise rotation of the force control drum 80. This limits the recoil of the force spring 40, for it cannot recoil unless an appropriate length of force control cable 62 has been unwound from the force control drum 80, which cannot occur if tab 84 contacts post 92.

Figure 12:
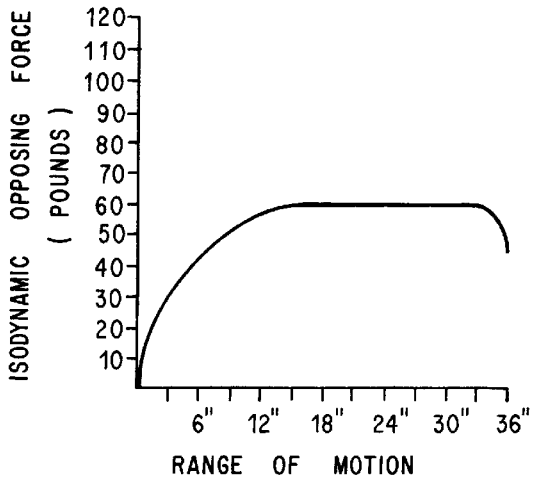

In the previous example, the force spring 40 stretched six inches, which corresponded to one complete revolution of th(e force control drum. This resulted in the user experiencing a total of sixty pounds of resistive force at the spring's most extended point (again assuming a linear spring having a spring constant of K=20 lbs/inch). If we now assume that the two posts 92 and 94 on the force transfer pulley 90 are located along a ninety degree arc from one another, then the following force reductions would occur. During the first ninety degrees of counterclockwise rotation of the force control drum 80 that accompanies the recoil of the force spring 40, a total of three inches of cable (corresponding to one-quarter of the drum's circumference) are released to the reeving of the force retention pulley 51. At this point the force control brake, acting through the force transfer pulley 90, prevents the force control drum from further counterclockwise rotation. This imposes a geometrical constraint upon the further payout of force control cable 62 from the force control drum 80. This payout of 3 inches of cable 62 allows the force spring 40 to recoil a distance of 1.5 inches (because of the reeving). Given the spring constant of 20 lbs/inch, this corresponds to a reduction in the spring tension of 30 lbs, or from 120 lbs to 90 lbs, which in turn is felt at the handle 56 as 45 lbs of load. The additional structure set forth in FIG. 2 is thus seen to prevent the spring from experiencing a total recoil which might otherwise have deleterious consequences (see the graph in FIG. 12).

As the user commences the next repetition, the starting resistive force that must first be overcome is the forty-five pounds of captured resistive force provided by the spring which is now pre-extended to 4.5 inches. Since the maximum force which the user may be capable of exerting at the start of the workout may be higher than the maximum force exerted in the first repetition, the force spring 40 may be extended beyond the previously attained six inches of the previous repetition. We will assume that in the second repetition, the user applies a force sufficient to stretch the spring seven inches. During the first one and one-half inches of force spring extension beyond its starting length of 4.5 inches extension, the force control drum 80 rotates clockwise ninety degrees, which would again place tab 84 of the force control drum 80 in contact with the forward post 94 of the force transfer pulley 90. The final one inch extension of the force spring from six to seven inches will cause the force control drum 80 to rotate an additional sixty degrees, which will cause the force transfer pulley 90 to rotate along with it in the clockwise direction for these final sixty degrees.

As the user again reaches the conclusion of the positive range of motion exertion, the velocity of the user cable end at 56 will naturally tend to fall. Here again, as the user's effort slackens, the force spring 40 will again be prone to execute a rapid recoil. However, the velocity of the recoil will be controlled by the force control drum 80, as its counterclockwise rotation will again cause the clutch bearing to lock its rotational speed to the speed of rotation of the output shaft 20 of the wormgear. In this manner the speed of rotation of the output shaft 20 imposes an upper limit on the rate at which the spring can recoil. After ninety degrees of counterclockwise rotation, the force control drum's tab will again contact the force transfer pulley's rear post which will stop further counterclockwise rotation from occurring.

When the force spring 40 reaches the full 7 inches of spring extension for the repetition, the total resistive force experienced by the user is seventy pounds (one-half of seven times twenty). As the force spring 40 then recoils under the velocity control provided by the force control drum 80, its contraction will continue until the extension of the force spring falls to five and one-half inches (the clockwise rotation of the force transfer pulley 90 having advanced the position of post 92, the location of which limits the extent to which the spring can return to its starting state). At this point the tab 84 of the force control drum 80 will contact the force transfer pulley's rear post 92 bringing to an end the counterclockwise rotation of the force control drum 80. The result is that the level of tension of the force spring at the conclusion of each repetition is now captured at a new initial level of fifty-five pounds (see the graph in FIG. 13).

In other words, the force spring's resistive effort threshold for the next repetition has been established in dependence upon the maximum force provided by spring in the previous repetition, which in turn was determined by the user's, maximum effort during that previous repetition. The threshold level of subsequent repetitions will increase so long as the user chooses to increase the maximum load he applies during a repetition, or until the user's strength or exerted effort can no longer cause the tab 84 of the force control drum 80 to further rotate the force transfer pulley 90 in an increasing clockwise direction. A series of four repetitions characterized by increases in user effort in each repetition is illustrated in the graph in FIG. 14.

The mechanical system thus described may be provided with sensors and displays (e.g., a video display screen) to provide the user with a wide range of suitably presented information concerning his workout (e.g., peak load, mechanical work, calories of work performed, etc.). For example, the microprocessor may be provided with information from a potentiometer fixed with respect to the frame and driven in a clockwise or counterclockwise direction by a lever protruding from the floating pulley bracket. The potentiometer can be calibrated and the microprocessor programmed to detect and translate each one four-hundredth of an inch of movement by the spring into pounds of force. The microprocessor can be used to display the load matched by the user in sub-pound increments.

A second potentiometer may be configured to be driven by the rotation of the speed control drum 80. This potentiometer would provide information that allows the microprocessor to track the starting and ending point of each user repetition. This information is important in detecting reductions in user strength or effort reduction levels during successive repetitions. If at the conclusion of a repetition, the microprocessor determines that the force control drum 80 has been rotated clockwise by less than thirty degrees during a positive concentric contraction, it can bring about a lowering of the initial load provided from the next repetition by activating the force control solenoid 116. The solenoid's action will cause the brake release collar to be rotated one degree, which will be sufficient (depending on the hardware used) to release the force control brake. As the force spring 40 recoils, the force control drum 80 rotates counterclockwise until tab 84 contacts the rear post 92 on the force transfer pulley 90. If the microprocessor has directed that the force control brake be released, this contact will allow the force transfer pulley 90 to rotate in the counterclockwise direction. The microprocessor monitors this movement by receiving a signal from the potentiometer or other sensor measuring the motion of the floating pulley bracket 50. This continues until it is determined that the force control drum 80 rotated an amount sufficient to permit the force spring 40 to recoil by a predetermined amount below its previously retained level, e.g., one inch. This additional one inch recoil in the force spring corresponds to a thirty degree counterclockwise shift in the position of both the rear post 92 and forward post 94 beyond the previous brake holding point. Once this movement is completely detected the microprocessor releases the solenoid, which allows the spring loaded force control brake release collar to return to its "on" position, which again locks the brake control shaft 102, the brake control pulley 104, the force transfer pulley 40 and the force control drum 80 from further counterclockwise rotation. The system could be configured to unlock and lock the braking collar upon detection of other increments of force or displacement as well. Where the user does not want to increment the initial load, the solenoid could be left in its activated state which would keep the brake open and thereby permit the force transfer pulley 90 and force control drum 80 to freely rotate in the counterclockwise direction. This would permit the spring to recoil to its neutral state, subject only to the speed-braking effect provided by the rotating shaft 20.

Figure 13:
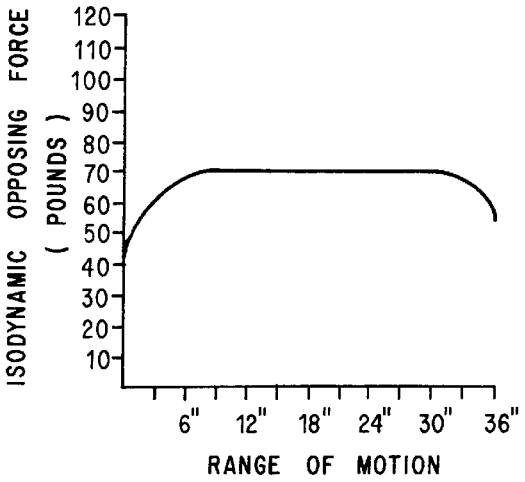
Figure 14:
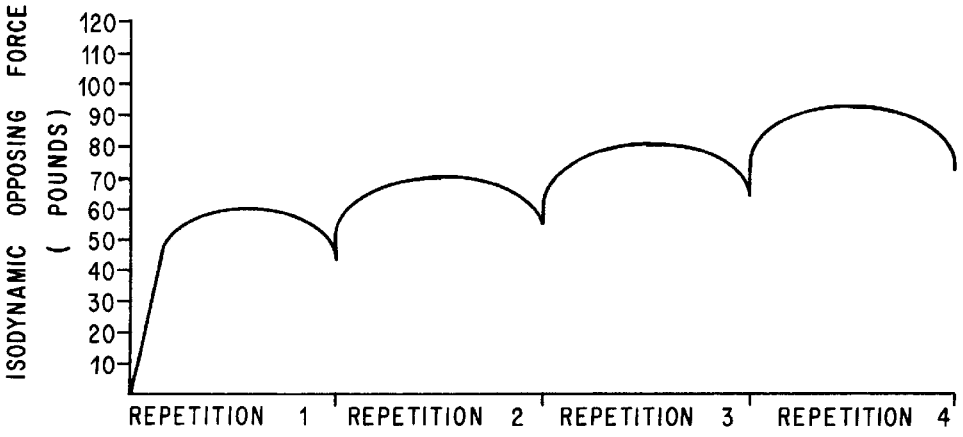
Figure 15:
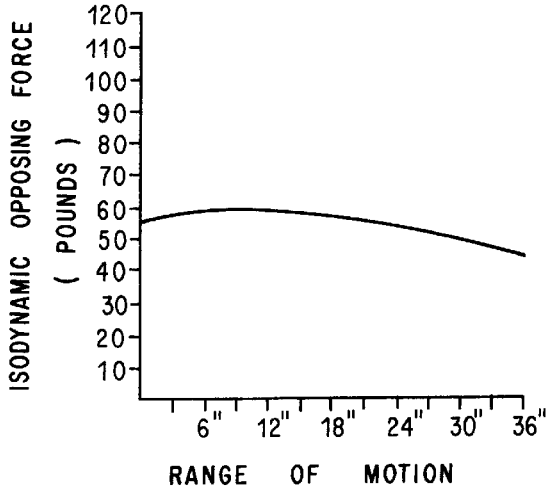
Figure 16:
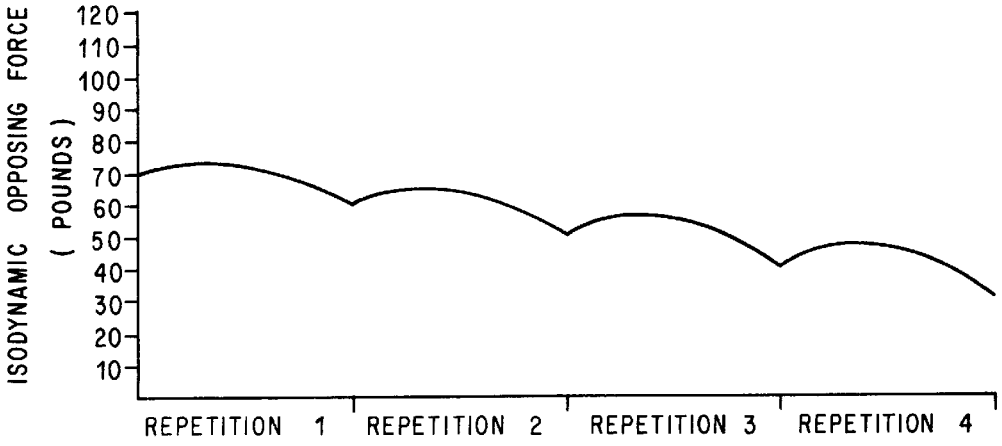
Figure 17:
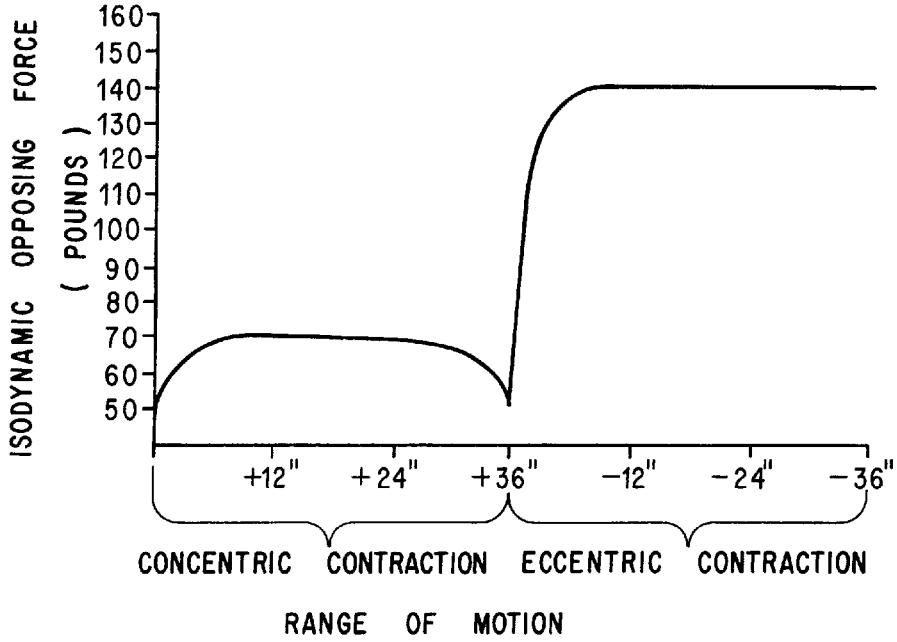

The operation of this system is further seen in the graphs in FIGS. 13–15, where the retained force level from the preceding repetitions is fifty-five pounds (see the graph in FIG. 13), then the operation of the force reduction system would result in the retention of a user experienced resistive force of forty-five pounds as the starting load of the next repetition (see the graph in FIG. 13). If during this next repetition the user should fail to cause the force control drum to rotate at least thirty degrees (or some other predetermined interval) during his total range of motion, then the microprocessor would again lower the force spring threshold by decrementing the force spring's retained extension by one inch corresponding to a reduction in the load experienced by the user of ten pounds allowing the force control drum to rotate counterclockwise an additional thirty degrees beyond its previous brake holding point of rotation. A series of 4 repetitions with ever decreasing user exerted effort would create a force curve as shown in the graph in FIG. 14.

The result is that the force control mechanism, the microprocessor/potentiometer and the user's level of exertion are in a closed interactive loop. If the user's maximum strength or exerted effort, during a given positive concentric contraction range of motion excursion, exceeds the maximum exertion attained during the preceding repetition, then the force control mechanism will automatically and mechanically, increase the force spring's level of retained resistive force provided at the threshold of the next repetition. The increase in the threshold resistive force applied will equal the amount by which the previous repetition's maximum exertion exceeded the highest previous repetition's maximum exertion. While the system for positively incrementing the force level retained can, as described, be based on simple mechanical elements (in contrast to the decrement of the force levels, which requires microprocessor control), more individual changes in the pattern of force incrementation could be realized through the use of microprocessor control over electro-mechanical actuators in place of the simple mechanical tab arrangement employed in this embodiment.

As the muscle begins to experience fatigue, the exertions attendant with each repetition tend to diminish in intensity with each succeeding repetition. As the microprocessor detects this occurrence, it signals the solenoid-brake structure to modify the counter-clockwise position of stop 92 on force transfer pulley 90, which, as explained above, sets the threshold level on the force sprinc 40, thereby proportionally reducing the resistive force threshold for each succeeding repetition. (In an alternative embodiment, a microprocessor controlled brake and motor could be used to provide more elaborate control over the brake control shaft 102 and thus over the position of the stops 92 and 94.) This allows the fatiguing muscle to continue to reach its maximum force resistance capability through each repetition until reaching complete muscle failure. This is accomplished with only a minimal possibility of muscle damage, since the force which the user works against is limited by his own varying strength capabilities.

3. Negative Force Generating System.

The previous discussion addressed the provision of positive resistance during a concentric range of motion exercise. A force suitable for an eccentric or negative excursion is provided for only a minimal time after the end of the positive excursion. The load developed in the spring at the end of the positive excursion is quickly dissipated by either the user's forward return movement of the handle 56 or the payout of cable from the speed control drum 30, which allows the force spring to return to its starting position (which through the agency of the force control system, may have a pretension). If the user attempts merely to hold the handle 56 in a fixed position with respect to the machine, a quantity of cable 60 sufficient to return the force spring 40 to its starting position (as controlled by the force transfer pulley) will simply unwind from the speed control drum 30.

FIG. 3 shows the embodiment of FIG. 2 with some additional elements that allow the apparatus to create negative force resistance during an entire eccentric range of motion movement as well. A secondary shaft 220 is mounted to the frame on bearings (not shown) that permit it to rotate in either a clockwise or counterclockwise direction. Mounted to the secondary shaft are a timing belt pulley 222 and a grooved force generating drum 224. The timing belt pulley 222 is rigidly secured to the secondary shaft. The drum 224 includes a center anchor 226 for accommodating the attachment of user cable 60 to the drum at its center section. The drum 224 is connected to the shaft 220 via a one-way clutch that permits only the counterclockwise rotation of the drum with respect to the shaft.

In this embodiment, the wormdrive has been modified to provide an extended shaft 22 on the gearbox side opposite to where the speed control pulley 90 is located. A timing belt drive pulley 240 is attached to the extended shaft 22 in a freely rotating condition. A uni-directional drive-clutch 230 is mounted on the shaft in such a fashion that its engagement will cause the floating timing belt drive pulley 240, which is connected to the outside hub of the drive-clutch, to rotate in the direction and at the speed of the extended shaft. When the clutch is disengaged, the free floating drive pulley 240 is allowed to freely rotate in either direction. A timing belt 250 is used to connect the extended shaft drive pulley 240 to the secondary shaft's driven timing belt pulley 222.

The user cable 60, that in the previous embodiment had led from the reel spring drum 70 directly to the speed control drum 30, is now re-routed. Like the speed control drum, the force generating drum 224 has cable grooves on either side of the center anchoring point. The cable is wrapped about the center half of the drum so that the inner and outer quarter sections are initially free of cable 60. The cable 60 is anchored to the drum via the threaded bolt 226. The cable is advanced to the speed control drum 30, where the cable wrapping and routing, as outlined in the discussion of the positive workout force generating system, continues to the point of user engagement.

The concentric contraction portion of the stationary rowing action, outlined with respect to FIGS. 1 and 2, causes the same interaction and behavior among the user, the force spring assembly, the speed control drum, the wormgear assembly and the reel spring in the embodiment shown in FIG. 3. During the user's concentric contraction movement, the force generating drum 224 is used only as a cable transfer idler between the spring reel 70 and the speed control drum 30.

The force generating drum 224, however, plays a major role in the development of negative resistance for the execution of an eccentric excursion. At the conclusion of the user's concentric contraction portion of the statutory rowing movement, the force spring 40 is allowed to recoil to its captured retained force condition prior to utilization of the negative resistance portion of the repetition. Assuming that the user engagement point 56 of the cable is held at a more-or-less fixed extended position, the force spring pulley 52 retracts by drawing cable 60 from the speed control drum 30 in order to allow the force spring to recoil to its position of retained force.

Either the user manually (by using suitable hand or foot controls, depending on the exercise in question) or the microprocessor automatically closes a circuit to activate engagement of the force generating clutch assembly. The extended shaft 22 continues to turn at its set speed (selected at the beginning of the workout) in a counter-clockwise direction. As the force drive clutch 230 engages, it causes the force drive pulley 240, the force driven pulley 222 and the force generating drum 224 to rotate in a counterclockwise direction.

The cable wrapping orientation on the force generating drum 224 is such that its counterclockwise rotation will cause cable to be wound onto it from the speed control drum 30. This in turn causes the speed control drum 30 to rotate clockwise, which causes the speed control drum 30 to start drawing cable 60 from the reeving located between it and the user handle 56. If the user does not let the cable end at handle 56 move toward the re-directional pulley 54, then the cable take-up requirements for the speed control drum 30 must be met through the forward movement of the force spring pulley 52 resulting in the extension of the force spring 40.

As the speed control drum 30 continues to reduce the amount of cable between it and the handle 56, the tension of the force spring will continue to increase. Even though the user's negative strength is typically twice the user's positive strength, the power train capacity of the apparatus will continue to cause increased tensioning of the force spring 40 until its force can no longer be resisted by the user. At this point, the user will move the handle 56 towards the re-directional pulley 55 in a negative, eccentric movement. As long as the user's movement continues at the same speed as the cable is being drawn by the speed control pulley 30, the force spring's tension will remain constant and the user will experience the same sensation as he would experience while engaged in negative weight training against gravity. Graph 14 illustrates one possible concentric-eccentric loading pattern.

The negative force system can be activated at or near the end of the concentric contraction range of motion. Again, the negative force increases until the user cable 60 end is allowed to move toward the re-directional pulley 55, marking the beginning of an eccentric contraction. This would cause the increase in the negative force to subside and equalization of the user's resistive force and the apparatus generated negative workout force to occur. As the user reaches the conclusion of his eccentric range of motion, fatigue and decreasingly favorable leverage geometries will typically cause a decrease in the user's ability to continue sustaining the resistive effort reached earlier in the negative stroke.

This will naturally lead to an increase in the velocilty of the user cable 60 at the handle, as the user's control begins to "give". The speed control drum 30 will not take up this returned cable, which means the force spring pulley will be allowed to move in a direction that causes a reduction in the tensioning of the force spring 40 to just equal the reduction in the user's resistive effort. The force capture system can additionally be utilized to increment or decrement starting loads as described above.

Figure 18:
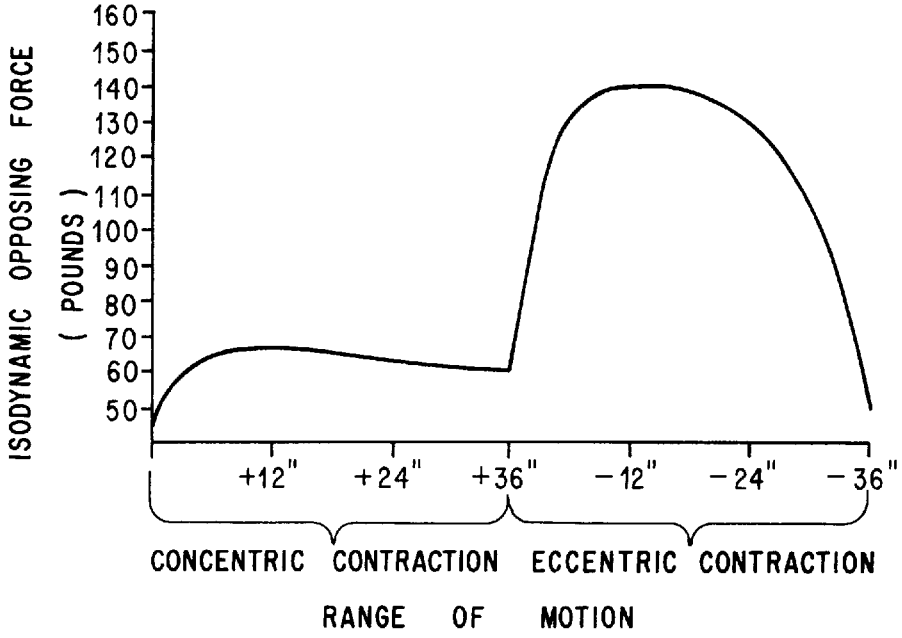

As during concentric strokes, there is a balancing of the user's resistive effort and the force level within the force spring 40 throughout the eccentric range of motion exertion. At the conclusion of the eccentric range of motion exertion, the force generating clutch assembly 230 is disengaged, either by the microprocessor or the manual activations of a switch. This will allow the force spring 40 to draw any additionally needed cable 60 from the speed control drum 30 in order to return the spring 40 to its pre-tensioned state. At the conclusion of the eccentric contraction, the microprocessor will allow the retained force spring to drop to a level 15 pounds below the maximum force achieved during the preceding concentric contraction (see the graph in FIG. 18).

An alternative means for generating the forces necessary for a negative workout is to use a bi-directional motor along with a bi-directional clutch inside of the drums.

Without compromising the ability to execute any of the previously attained abilities, the apparatus is capable of providing negative resistance for eccentric contraction strength training. This has been accomplished in a way that satisfies two previously outlined objectives. First, the resistance increases its opposing force in proportion to the decrease in the velocity of the exercised muscle's range of motion, and second, the resistance decreases its opposing force proportional to the exercised muscle's range of motion velocity increases.

4. Electronic Subsystem.

Certain elements of the apparatus' electronics have been discussed in previous sections. A more detailed discussion is appropriate in order to explain how the electronics interface with the more subtle applications of the apparatus' unique design.

In its simplest form, the electronics consist of four primary components: first, the microprocessor which is housed within and a part of the display console used to provide digital and graphic displays of the user experienced apparatus interface data; second, a potentiometer used in conjunction with the user and of the operations cable to determine the user's range of motion plus detection of the excursion's direction of travel; fourth, the power supply and motor speed controller.

During use of the apparatus, the user will be provided with the option to select the rotational speed of the motor driven output shaft 20, which will set a baseline objective for each repetition. Once the selection is made and keyed into the console, the microprocessor will send a signal to the motor speed controller. The motor speed controller will respond by providing the appropriate voltage levels to the DC motor in order that the motor's output shaft RPM provide the proper speed to the wormdrive input shaft. The reduction ratio of the wormdrive will cause the wormdrive output shaft to turn at the speed required for the potential accomplishment of the repetition's baseline speed objective.

The wormdrive reduction ratios are such that the unit is not susceptible to back drive overspeeding. The motor speed controller will, however, continuously monitor the DC motor's speed and make any appropriate voltage adjustments to further ensure that the user chosen speed is maintained during each repetition. The microprocessor could be programmed to provide speed variation signals to the motor speed controller resulting from potentiometer collected data, or user selected variation options.

As the user commences a repetition, the microprocessor will interpret the force potentiometer data and cause the console LED display to provide a digital readout of the corresponding apparatus resistive forces in pounds. The incremental variations of this display can be as finite as one pound. The range of motion potentiometer data will also be interpreted by the microprocessor which will then cause the console to provide either digital or graphic presentation of the travel through the range of motion. The incremental variations of this display can be as finite as one-tenth inch.

The user will have the option to manually control the release or application of the force control brake. The engagement or disengagement of the force generating clutch will also be provided with a user control option. The force control brake and/or the force generating clutch will also be controllable by the microprocessor at the option of the user.

For safety purposes the microprocessor will be programmed to override the manual force generating clutch control in all circumstances if collected data from the force potentiometer indicates that established force maximums have been reached during the negative force generating mode. If during the force generating mode the microprocessor clutch disengagement command does not stop the increase of the generated negative force then the microprocessor will send a digital signal to the motor speed controller causing it to cease sending current to the motor. There will also be a mechanically activated backup system that will function to shut the total apparatus down in event that the force generating spring exceeds the maximum predetermined length of travel.

The microprocessor will also be programmed so that it can be directed to collect data on a user's sample range of motion (no resistance) repetition. Hence, during eccentric contractions the microprocessor will monitor the range of motion potentiometer data and disengage the force generating clutch at the point where 95% of the repetition's excursion has been concluded, as compared to the sample repetition. This mode is offered to avoid inadvertent overstretching of the muscle. There will also be a mechanical sensor switch that will be activated at a predetermined conclusion point of the apparatus' physical travel; activation of this switch will cause the electric DC motor to be shutdown.

The microprocessor will also be programmed to provide a preloaded negative/positive repetition mode. The user will select this mode and activate the microprocessor through a console keyed input. The user will also select and key the baseline apparatus speed to the microprocessor. Additionally, the user must select and key the preload pound objective to the microprocessor.

With the apparatus running at the desired speed, the user will move the user cable end to a position preparatory for commencement of an eccentric repetition. To activate the program, the user will cause the user cable end to retract toward the re-direction pulley. The microprocessor will detect this movement from the range of motion data and immediately engage the force generating clutch. The user will offer concentric contraction resistance at a level above the retained resistive force threshold while still allowing the user cable end to be drawn toward the re-directional pulley.

As the user approaches the natural conclusion of the eccentric range of motion, a maximum resistive effort will be exerted. The user will commence to perform a positive concentric contraction in opposition to the apparatus' exerted negative force. The increased user resistive effort in opposition to the apparatus exerted force will cause the apparatus' exerted force to increase. Data provided to the microprocessor from the force potentiometer will allow the program to detect when the apparatus' exerted force has reached the level keyed into the processor as the preload pound objective. When the objective has been detected the negative force clutch will be disengaged. This action will allow cable to be released from the speed control drum to conclude the positive concentric contraction.

At the conclusion of the concentric contraction any movement of the user cable end toward the re-directional pulley will again be detected by the microprocessor. At that time, the force generating clutch will again be engaged to commence the next pre-load negative/positive repetition. Through preloading, the user's muscle or muscle group will be allowed to exert higher levels of positive contractile effort than could be accomplished without preloading. Preloading "shocks" the muscle or muscle groups which will react over time by increasing strength and size.

During the entire text, we have addressed the advantages of the invention's ability to provide a resistive force equal to the positive exerted effort provided by the user. In the negative, the invention's ability to provide an exerted force equal to the user's resistive effort has also been discussed. In certain rehabilitation applications this ability is undesirable as a patient may not have total sensory capacity and thereby not be able to determine their negative resistive or positive exerted effort. In other cases, it may not be desirable to allow a patient to exceed a physician's or therapist's predetermined level of negative or positive effort.

In the previous discussions, the speed control drum's control of the operation cable's velocity caused changes in the user cable end velocity to increase or decrease the forces provided by the apparatus to the user. In order to control the potential levels of resistive or exerted forces provided by the apparatus, one only need to provide the apparatus with the ability to change the RPM of the speed control drum proportionally to the user cable end velocity changes. Velocity changes could be detected by the range of motion potentiometer data, however, a more sensitive source is desirable. Force spring potentiometer data could also be considered, but it, too, is not sufficiently sensitive.

A load cell will, therefore, be added at the point of connection between the force spring and floating pulley bracket. During operation, data from the load cell will be monitored by the microprocessor. The microprocessor will be programmed so that an operator of the apparatus can enter the maximum amount of apparatus force that the user/patient can be allowed to experience during either a positive or negative repetition.

In the performance of a controlled resistive force positive concentric contraction, the operator can have the repetition begin with a force spring retained resistance threshold of zero or, through utilization of the negative clutch, increase the retained force threshold to any level desired. We will assume that the physician has established a maximum apparatus resistive force of forty (40) pounds at an apparatus baseline repetition objective of six (6) seconds with a retained resistance threshold of thirty (30) pounds.

After the operator has set the retained resistance and keyed the information into the microprocessor, the user/patient can begin their exercise. If the user/patient does not cause a user cable end velocity faster than the velocity required for doing the repetition in less than the six second apparatus baseline, then the 30 pound preload will not be exceeded. In other words, the user/patient will experience no resistance during the repetition.

When the user's repetition velocity causes more cable to be required at the user cable end than is being made available from the speed control drum, the result will cause the force spring to be extended which causes an increase in the resistive force. The microprocessor will monitor the resulting resistive force increases from the load cell and will attempt to project the point in time when the increased user end velocity will cause the 40 pound maximum resistance to be achieved.

As the force as measured by the load cell reaches 95% of the maximum desired level, the microprocessor will make its first corrective action to the speed control drum's RPM by increasing the DC motor speed by one-half the amount estimated as being required. An immediate sample of the resulting force, as measured by the load cell, will be taken and 50% corrective speed increase or decrease action will again be undertaken. This sample and corrective action procedure will continue at a frequency of which approximates the rate of change of user applied forces, e.g., the system "tracks" the user's effort.

If the load cell reflects an increase in the apparatus resistive force above the desired resistance level, then the motor's speed will be increased. If the load cell reflects a decrease in the apparatus resistive force below the desired resistive level, then the motor's speed will be decreased. The objective is to have the speed control drum release stored cable at a velocity equaling the user cable end velocity. This cause the floating pulley bracket's position and the force spring's distance of extension to provide the desired resistive force levels throughout the entire range of motion during each repetition.

The key factor in accomplishing this objective is the ability to adjust the speed of available cable from the speed control drum. This constantly changing speed will result in fluctuations of the time required for completing the repetition. In order to minimize, somewhat, these variances, the apparatus speed adjustments will not be allowed to go below the target baseline speed objective. In practice, the variations will be an acceptable sacrifice to accomplish the safety objective of not allowing the user/patient to experience forces above those established as maximum.

In the performance of a negative force controlled eccentric contraction, the order of events will reverse. We will assume that the physician has again established a 40 pound maximum force with a retained force threshold of 30 pounds and an apparatus baseline repetition objective of 6 seconds. After the operator sets the retained resistance level and keys the information into the microprocessor, the user/patient will move the user cable end to a position preparatory to begin the eccentric contraction. The worm output shaft will be turning at a speed compatible with the performance of a 6 second repetition. The operator or microprocessor will cause the force generating clutch to engage.

The force generating drum will then start to wrap cable at the cable's live dead end. The user/patient will resist the developing force as it increases from the 30 pound retained resistance level toward the desired 40 pound resistance level. The microprocessor will monitor the load cell to measure the forces and to project the accomplishment of the 40 pound maximum objective.

As the increasing force reaches 95% of the maximum desired force, the microprocessor will cause the DC motor speed to be reduced, causing progression toward the 40 pound force objective to slow. If the user/patient continues to resist the developing force and to not perform the eccentric contraction, then the motor will be continually slowed as the force approaches the maximum. The microprocessor will bring the motor to a complete stop when the 40 pound maximum exerted force is obtained.

As the user/patient yields to the 40 pounds of exerted force and starts to perform an eccentric contraction, force reductions caused by the release of user cable end will be detectable by the microprocessor from the load cell measurements. In response, the microprocessor will immediately increase the DC motor speed which will cause the force generating drum to again take in cable at the cable live dead end. The microprocessor will continuously monitor the load cell in an effort to make corrective speed adjustments to the force generating drum. These adjustments will be made at a frequency that will consume cable at a speed equal to the cable being made available from the eccentric contraction, thereby "tracking" the exerted force by changing the velocity at the user cable end. The velocity equalization of the two cable ends will keep the floating pulley bracket's position and the force spring's distance of extension at the desired resistive force levels.

If at any time during the eccentric contraction the user/patient attempts to perform a concentric contraction, the change in load cell and range of motion potentiometer data will trigger a reaction by the microprocessor. The microprocessor will immediately disengage the force generating clutch and assume its programmed behavior for the controlled resistive force mode. In this way, the 40 pound maximum objective will be maintained even during potential misuse.

As with the resistance controlled positive repetition, the force controlled negative repetition will have repetition speed variations on either side of the apparatus baseline.

During either positive or negative repetitions, the benefits of controlling the user experienced forces far outweighs any potential negatives resulting from repetition speed variations.

I claim:

1. An exercise apparatus comprising:

a frame;

a constant speed drive device mounted on the frame and having an output shaft that rotates in a preselected direction at a constant speed independent of torque loading;

a user force application means having a point for application of user force, the user force application means comprising an elongated flexible tension mechanism, the point of applied force being a free first end of the tension mechanism, and a speed control drum connected to the one-way clutch device, a portion of the flexible tension mechanism intermediate the free first end and an opposite second end being wound around the speed control drum such that a tension force applied to the point of user force application tends to turn the drum in the preselected direction;

a one-way clutch device coupling the user force application means to the output shaft, the one-way clutch device transmitting torque from the user force application means to the shaft only in response to a force, applied to the point for application of user force, tending to turn the user force application means from an initial position in the preselected direction relative to the shaft;

a force spring device operationally interposed between the point for application of user force on the user force application means and the one-way clutch device for providing a spring biasing resistance to an applied force tending to turn the user force application means in the preselected direction relative to the shaft;

means for selectively rewinding the flexible tension mechanism onto the speed control drum at said constant speed, said means comprising:

a force generating drum;

a selectively engageable drive clutch for coupling the force generating drum to the output shaft; and a length of the flexible tension mechanism being wound around the force generating drum in a direction opposite to the winding direction of the tension mechanism on the speed control drum; and a rewind biasing device connected to the user force application means and biased to return the tension mechanism to the initial position.

* * * * *